United States Patent [19]

Lu

[11] 4,176,078

[45] Nov. 27, 1979

[54] FIELD DEPENDENT TONER HAVING CHROME COMPLEX COATED MAGNETIC PARTICLES

[75] Inventor: Chin H. Lu, Webster, N.Y.

[73] Assignee: Xerox Corporation, Stamford, Conn.

[21] Appl. No.: 802,770

[22] Filed: Jun. 2, 1977

[51] Int. Cl.[2] ..... G03G 9/14

[52] U.S. Cl. ..... 430/109; 430/45; 427/218

[58] Field of Search ..... 96/1 R, 1.5 D; 252/62.1 P; 427/218

[56] References Cited

U.S. PATENT DOCUMENTS

| | | | |
|---|---|---|---|
| 2,846,333 | 8/1958 | Wilson | 427/18 |
| 3,639,245 | 2/1972 | Nelson | 252/62.1 |
| 3,698,005 | 10/1972 | Nacci | 252/62.1 |
| 3,909,258 | 9/1975 | Kotz | 96/1 R |
| 4,024,084 | 5/1977 | Sittardt et al. | 252/62.1 R |

OTHER PUBLICATIONS

DuPont Quilon, pp. 1-12, 1/68.

*Primary Examiner*—Roland E. Martin, Jr.
*Assistant Examiner*—John L. Goodrow

[57] ABSTRACT

A method of coating pigment particles such as magnetite with a fatty acid chrome complex is disclosed. The magnetite pigments coated by this process are found to be particularly suitable for use in formation of field dependent toners.

4 Claims, No Drawings

FIELD DEPENDENT TONER HAVING CHROME COMPLEX COATED MAGNETIC PARTICLES

BACKGROUND OF THE INVENTION

This invention relates to electrophotographic development utilizing magnetic toner particles which are applied from magnetic brush to the electrostatic latent image without use of a carrier material.

There have been suggested systems for magnetic development not utilizing carrier material. One such system was described in U.S. Pat. No. 2,846,333 to Wilson. Wilson et al disclosed the use of magnetic brush to apply toner particles formed of ferrites and resin material to develop electrostatic latent images. The difficulty with this process was the conductivity of the toner made electrostatic transfer difficult.

A further development of magnetic development without carriers is illustrated by Kotz, U.S. Pat. No. 3,909,258 wherein an electrostatic development process utilizing a magnetic brush without carrier is illustrated. A toner suitable for use in the Kotz process is disclosed in U.S. Pat. No. 3,639,245 to Nelson wherein a dry toner powder having specific electric conductivity is disclosed. The toner of Nelson is formed by blending magnetite with the resin and then after blending pulverizing to a small particle size. The particles are then mixed with conductive carbon black which is imbedded in the surface of the particle and then a small particle size $SiO_2$ agent is mixed into the toner to improve the flowability. The toner of Nelson suffers the disadvantages that it does not transfer well from a photoconductive substrate to plain bond paper.

Therefore there is a continuing need for magnetic toners suitable for use in one component magnetic development systems. There is a need for toners suitable for high speed development that also have good electrostatic transfer characteristics for transfer from a photoconductive surface to plain bond paper. There is further a need for a magnetic pigment coating which aids field dependence without introducing undesirable properties such as humidity sensitivity into the toner. There is further a need for methods of rendering pigments hydrophobic and more easily dispersable in polymers.

There is a need for toners which after they are transferred to paper adhere sufficiently well by electrostatic forces that image disturbances (blur) do not readily occur on handling the unfused toner image prior to fixing.

In copending application, Ser. No. 792,636, filed May 2, 1977, titled: "Single Component Magnetic Toner" which is hereby incorporated by reference, it is disclosed that coating of magnetic pigments with fatty acids prior to mixing with resin and spray drying to form a toner will produce field dependence toner. However, there is a continuing need for additional field dependent toners.

There is also a need for coated magnetic pigments in the printing industry. There is a continuing need for pigment having hydrophobic characteristics such that it is suitable for use in multilith inks.

SUMMARY OF THE INVENTION

It is an object of this invention to provide a toner and coated pigment overcoming the above noted deficiencies.

It is a further object of this invention to provide a process of coated pigment and toner manufacture that overcomes the deficiencies of the above noted processes.

It is another object of this invention to produce clear sharp images by magnetic development using a coated pigment without using a carrier.

It is a further object to produce pigment for a toner that will transfer electrostatically from the photoreceptor to plain bond paper.

It is another additional object to form a coated pigment that is hydrophobic.

It is a still further object to produce a coated pigment for toner whose electrical resistivity is field dependent.

It is still a further object to provide field dependent toners for electrostatic imaging.

It is another object of this invention to provide coated pigments that will form toners that do not blur upon handling of unfused toner images.

It is still an additional object of this invention to form coated pigments by a simple process.

The above and other objects of the invention are generally accomplished by adsorption of a fatty acid chrome complex onto magnetic particles. The coated magnetic particles may be dispersed in solvent solutions of toner resins and spray dried to form toners. The toners formed by the invention may be utilized in carrierless inductive magnetic brush development systems to develop electrostatic latent images.

In a specific embodiment in accordance with the invention magnetic particles of magnetite are treated with a water diluted solution of a Werner type fatty acid chrome complex of a myristic acid. The particles are separated from the aqueous solution, washed and dispersed in a solvent solution of a polystyrene toner resin. The dispersion is spray dried to form toner particles which are utilized in electrophotographic development and transfer.

DESCRIPTION OF THE INVENTION

The toner formed from the coated pigments of the instant invention generally have resistivity that is dependent on the strength of the electrical field. The field dependent resistivity change of these toners allows transfer processes without use of specially treated paper or transfer techniques such as pressure or use of adhesives. Further the toner is conductive at high fields so as to easily develop by inductive techniques.

The toners with the coated pigment of the instant invention have a resistivity of greater than about $10^{12}$ ohm-cm at low fields of about 10 volt/cm. It is preferred that the high resistivity of greater than about $10^{12}$ ohm-cm be maintained at least up to about 100 volt/cm field strength. The preferred initial resistivity is greater than $10^{14}$ ohm-cm as this allows good transfer of the electrostatic image. The toners with the coated particles, of the invention, display a substantially stable resistivity as field strength increases and then have a sharp break point where the resistivity rapidly decreases.

The magnetic pigments and toners of the invention are referred to as magnetic because they are attracted to a magnet. They are not themselves magnets. The toners are held to a magnetic brush roller or belt by magnetic forces. The magnetic brush applicator is biased to induce a charge, opposite to that carrier by the photoreceptor, into the toner particles. Then the outer particles develop the electrostatic image as the electrostatic forces overcome the magnetic forces to deposit toner in the image areas. The earlier referenced U.S. Pat. No. 3,909,258 has illustrations of the forces present in the developing process utilizing a magnetic brush system without a carrier.

The magnetic pigment used to form the coated pigment of the invention may be any suitable particle which will give the desired magnetic and electrical properties in a toner subsequently formed. Typical of such materials are ferrites, iron particles and nickel alloys. Preferred for the instant process are magnetite particles as they are black in color, low cost and provide excellent magnetic properties. The magnetite particles may be of any shape and any size which results in a semiconductive particle with good transfer properties. Generally the particle size is between 0.02 micron and about 1 micron. A preferred average particle size for the magnetite particles is about 0.1 to about 0.6 microns average particle size. The particles may be acicular or cubic shaped.

Any fatty acid chrome complex that results in a hydrophobic coating on the magnetite particle and field dependent toner may be utilized in the instant invention. Suitable fatty acid chrome complexes for adsorption onto magnetic particles are those which when dissolved in an alcohol such as isopropyl may be represented by the following formula:

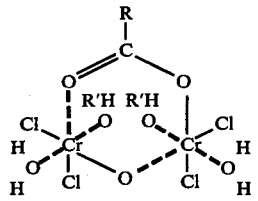

wherein R represents the fatty acid radical ($C_7$–$C_{17}$) and R' the alkyl group of a lower alcohol of about 3 carbon atoms.

With these materials dilution with water results in a replacement of alcohol groups with aquo groups and also some chlorine replacement resulting in a positive ion having the formula

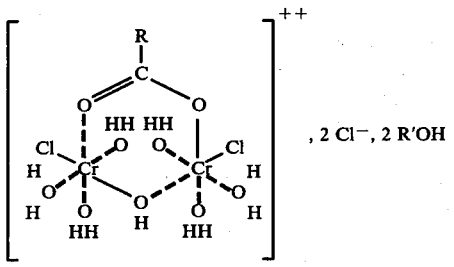

, 2 $Cl^-$, 2 R'OH wherein R represents a fatty acid radical of between 7 and 17 carbon atoms, subsequent hydrolysis or neutralization creates more chloride ions; the aquo groups lose protons and the molecules begin to grow. Hydroxyl bridges form as represented by the following structure

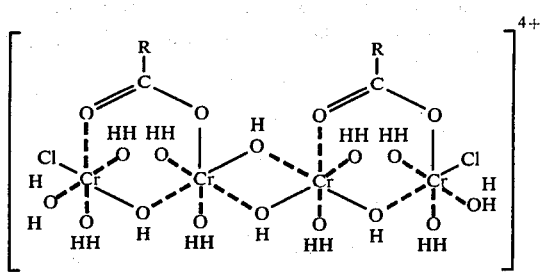

wherein R continues to represent a fatty acid radical of between 7 and 17 carbon atoms.

These molecules then are attracted by negative sites or groups on the magnetic particles and adsorb thereon in a structure represented by

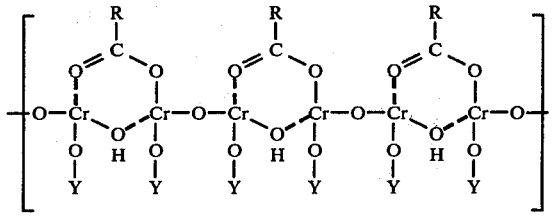

wherein R represents the fatty acid radical of between 7 and 17 carbon atoms and Y represents negative polar surface groups of the magnetic particles.

The fatty acid chrome complex may be present in any amount that results in a good hydrophobic coating on the magnetic particle. Generally, a suitable amount is between about 0.1 and 10 percent by weight of the magnetic particle. The method that may be utilized to determine if coating is complete enough is to coat the magnetic particles to such a degree that it will float on water.

The preferred chrome complex materials are those where R is a fatty acid of myristic ($C_{13}H_{27}$) or stearic acid ($C_{17}H_{35}$). These materials are preferred as they are readily available and form a good hydrophobic coating.

While not wishing to be bound by any theory as to why the instant toners display their remarkable field dependent properties it is believed that the properties are somehow related to the concentration of magnetic particles at the surface of the toner and that the coating of the magnetic pigment contributes to this higher concentration that results after spray drying. It is thought that the stability under humidity variance is related to the hydrophobic properties of the fatty acid chrome complex coating or to covering of hydrophilic groups on the pigment particles.

The toner resins for use with the coated pigment of the invention may be selected from any suitable toner resin material that is compatible with the coating of the magnetite.

While any suitable transparent resin possessing the properties as above described may be employed in the system of the present invention, typical of such resins are polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene; vinyl naphthalene; ethylencally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile., acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more other resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

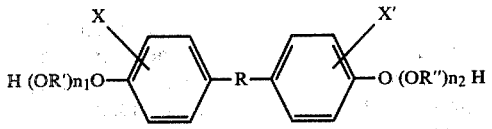

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' represent substituted and unsubstituted alkylene radicals having from 2 to 12 carbon atoms, alkylene arylene radicals having from 8 to 12 carbon atoms and arylene radicals; X and X'represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Preferred results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,1-bis(4-hydroxy-ethoxy-phenyl)-butane, 1,1-bis(4-hydroxy isopropoxy-phenyl) heptane, 2,2-bis(3-methyl-4-beta-hydroxy ethoxy-phenyl) propane, 1,1-bis(4-beta hydroxy ethoxy phenyl)-cyclohexane, 2,2'-bis(4-beta hydroxy ethoxy phenyl)-norbornane, 2,2'-bis(4-beta hydroxy ethoxy phenyl)norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R'' represent an alylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting or propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n_3}\ COOH.$$

wherein R''' represents a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist and formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resin modified phenol-formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Pat. No. Re. 25,136 to Carlson and polystyrene blends as described in U.S. Pat. No. 2,788,288 to Rheinfrank and Jones.

Any method of toner particle formation may be utilized with the coated particles of the instant invention which results in toner of the desired properties. The preferred method with the pigments of the instant invention is forming a solvent dispersion of the magnetite and toner resin and spray drying the dispersion as this results in toner particles having the magnetite concentrated on the surface and results in toner of good magnetic and electrical properties for excellent development and transfer to plain paper.

The solvent used for spray drying may be any material capable of dissolving the toner resin without adversely effecting the coating of the magnetite. Solvents for toner resins are well known including hydrocarbons, alcohols, ketones, esters, amides, fluorinated hydrocarbons, chlorinated hydrocarbons and other well known solvents. Preferred solvents are toluene for use with styrene polymer blends as this results in a toner that is solvent free and the solvent is low cost and relatively non-flammable. Chloroform has been found to be a preferred solvent for use with polyester type toner resins as it is readily available, non-flammable and results in a toner of low residual solvent. Both chloroform and toluene also are compatible with the preferred chrome complex coating for the magnetite. The solvent is generally used in an amount such that the solids content of the solvent slurry is 5–20% by weight. The term solids content is used here to indicate the solid resulting from spray during which is the resin and magnetite plus any other additives to the toner such as colorants or triboelectric regulators.

Magnetite coated by the instant inventive process is of very low humidity sensitivity which is an advantage in toner formation and further readily is dispersed in solvents and resins without effecting the properties of the coating.

While the above discussion has not included the addition of additives to the solvent prior to spray drying for inclusion in the toner it is encompassed that additives such as dyes, pigments, dispersing agents, humidity sensitivity control materials may be added prior to toner formation. Suitable black colorants are carbon black pigments and nigrosine dyes. The preferred magnetite materials coated by the instant process are black and therefore suitable for the majority of electrophotographic reproduction uses without benefit of colorant additives. However, other less dark colored magnetic materials might require pigment or dye additives to obtain a suitable toner color. Such pigments and dyes are not needed to obtain a suitable toner color. Such pigments and dyes are not needed to obtain the field dependency required of toners using the magnetite coated by the process of the invention.

While the above discussion has dealt primarily with magnetite pigments and their use in toners, the coating process and coated particles of the instant invention are also suitable for use in liquid inks and paints where low humidity sensitivity is an advantage. The coating process further may be used to coat pigments so that they do not react with the mediums that they color such as molding resins or powder coatings. Further at high loadings of over about 80% the coated particles of the invention may be incorporated in suitable mediums for the formation of permanent magnets.

It is further contemplated that after treatment processes such as classification might be necessary depending on the particle size range achieved by the spray drying.

DESCRIPTION OF THE PREFERRED EMBODIMENTS

The following Examples further define, describe and compare methods of preparing developers of the instant invention and of utilizing them in electrophotographic applications. Parts and percentages are by weight unless otherwise indicated.

EXAMPLE I

Eighteen (18) grams of Quilon M (myristic acid chrome complex, about 27–29% in isorpropyl alcohol, du Pont) was diluted with about 500 grams of deionized water. 200 grams of Pfizer magnetite MO4232 was placed in the solution and stirred at high speed for 15 minutes at about 20–25° C. After stirring, the slurry was filtered. The filter cake obtained was reslurried with about 700 grams of deionized water. The temperature of the slurry was kept at about 50° C. for 10 minutes. The mixture was filtered again. The cake was dried at about 100° C. for 16 hours. The clumps were broken up with a spatula.

The treated magnetite (in powder form) was placed in water. It floated on water, indicating its hydrophobic characteristics.

A toner containing the above Pfizer magnetite MO4232 treated with Quilon M is dispersed in a solvent solution of about 200 grams 65/35 styrene-n-butylmethacrylate and about 2000 grams of toluene. The dispersion is spray dryed using a Bowen spray dryer with a feed rate of about 200 milliliters per minute and a feed temperature of between about 180° F. and 220° F. is utilized. The power resistivity of this toner is $10^{16}$ ohm-cm at field strengths of up to 20K volt/cm. The toner was utilized in an induction magnetic development system without a carrier in a Mita Copystar 700D copier using ZnO paper and was found to produce images of good quality with low background. The toner by separate test is also found to transfer well electrostatically to plain bond paper. The ability of the toner to develop in an inductive magnetic brush system indicates that the toner is conductive at high field strengths and therefore field dependent.

EXAMPLE II

The process of Example I is repeated except about 18 grams of Quilon S a stearic acid chrome complex of about 28% in isopropyl alcohol is substituted for the myristic acid of Example I. This coated pigment is also hydrophobic and the toner produced therefrom exhibits good inductive carrierless magnetic brush development properties. The toner further transfers well electrostatically.

EXAMPLE III

The process of Example I is repeated except 22 grams of the chrome complex were used. The toner displays excellent transfer properties similar to Example I.

EXAMPLE IV

The process of Example I is repeated except 200 grams of Piccolastic D-125 a polystyrene resin is substituted for the resin. The toner demonstrates good development and transfer properties.

EXAMPLE V

The process of Example II is repeated substituting about 200 grams of Cities Service Mapico Black magnetite, a cubic magnetite as the magnetite. The print quality and transfer efficiency is excellent. The initial resistivity at low field is about $10^{15}$ ohm-cm.

EXAMPLE VI

The process of Example I is repeated substituting about 180 grams of 65/35 styrene-butylmethacrylate resin and about 200 grams of Cities Service Mapico Black as the magnetite. The toner has excellent transfer and development characteristics. It has an initial resistivity of about $10^{16}$ ohm-cm.

The resistivity measurements for toner used throughout this application are determined by the following process. Measurments on powder are complicated by the fact that the results are influenced by characteristics of the powder particles, shape and size in addition to powder composition. Therefore, measurements were obtained on powder rather than by molding the powder into a pellet specimen in order to better relate the properties to the toner behavior in development. The measurements were made using a two inch diameter electrode of a Balsbaugh cell for measuring the direct current resistivity of the toner. The gap distance is 0.05 inch. The toner is packed between the electrodes of the cell by vibration until a constant bed volume is reached. The current is measured as a function of applied voltage at the 50 mil gap. The electrification time is 1 minute as recommended by ASTM method. After each measurement the sample is repacked by vibration. Resistivity is calculated according to Ohms law.

Although specific materials and conditions were set forth in the above exemplary processes in the formation and using the toner of the invention these are merely intended as illustrations of the present invention. Various other substituents and processes such as those listed above may be substituted for those in the examples with similar results. In addition to the steps used by the coating of the present invention other steps or modifications may be used. For instance the pigment could be classified or separated by other filtering methods. In addition over materials such as colorants could be added.

The coated magnetic pigment of the invention may be utilized in any amount that forms a magnetic field dependent toner. A suitable range has been found to be a magnetic pigment content between about 40 and about 70 weight percent of coated magnetic particles in the finished toner. A preferred range is a coated magnetite content between about 45 and 55 weight percent of coated magnetite for good magnetic development properties and good transfer.

Other modifications of the present invention will occur to those skilled in the art upon reading the present disclosure. These are intended to be included within the scope of this invention. For instance, the coated magnetic particles of this invention could be utilized in formation of permanent magnets or in a paint as a magnetic coating. Further the coating method could be used to treat colored pigments for toner use to reduce humidity sensitivity.

What is claimed is:

1. A field dependent toner comprising a resin coated magnetic particles wherein the surface of said particles is represented by the formula

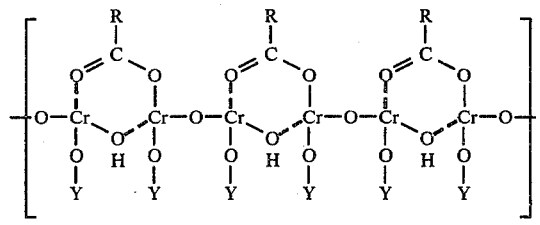

wherein R represents a fatty acid radical of between 7 and 17 carbon atoms and Y represents negative polar surface groups of the magnetic particles, said toner having a resistivity greater than about $10^{12}$ ohm-cm at fields up to about 100 volts/cm.

2. The toner of claim 1 wherein the coating comprises about 1 to 10 weight percent of the magnetic particles.

3. The toner of claim 1 wherein the coated magnetic particle comprises coated magnetite and said magnetite comprises about 40 to about 70 weight percent of the toner.

4. The toner of claim 1 wherein R consists of $C_{17}H_{35}$ or $C_{13}H_{27}$.

* * * * *